US009644926B1

(12) United States Patent
Greenwald

(10) Patent No.: US 9,644,926 B1
(45) Date of Patent: May 9, 2017

(54) COMPUTER REGULATED AND CONTROLLED IGNITION AND COMBUSTION PYROTECHNIC DISPLAY APPARATUS AND METHOD

(71) Applicant: Peter Greenwald, Denver, CO (US)

(72) Inventor: Peter Greenwald, Denver, CO (US)

(73) Assignee: Peter Greenwald, Santa Monica, CA (US)

( * ) Notice: Subject to any disclaimer, the term of this patent is extended or adjusted under 35 U.S.C. 154(b) by 344 days.

(21) Appl. No.: 14/521,426

(22) Filed: Oct. 22, 2014

(51) Int. Cl.
*F42B 4/24* (2006.01)
*G09F 13/46* (2006.01)

(52) U.S. Cl.
CPC ..... *F42B 4/24* (2013.01); *G09F 13/46* (2013.01)

(58) Field of Classification Search
CPC ..... F42B 4/24
USPC ..... 431/183, 18
See application file for complete search history.

(56) References Cited

U.S. PATENT DOCUMENTS 1,645,206 A 3/1925 Stevens
1,976,844 A 2/1932 Sion
4,737,100 A 4/1988 Schnell et al.
6,062,848 A 5/2000 Lifshits
8,113,825 B2 2/2012 Ormond
2002/0115033 A1* 8/2002 Hallit ..... F23D 14/36 431/183
2008/0206695 A1* 8/2008 Ormond ..... F23D 14/20 431/196

* cited by examiner

*Primary Examiner* — Avinash Savani
(74) *Attorney, Agent, or Firm* — Williams Intellectual Property; Benjamin F. Williams

(57) ABSTRACT

A computer regulated and controlled ignition and combustion pyrotechnic display apparatus and method for effecting the same, that includes a graticulate array of flue members oriented with an ignition end disposed in a common plane, each flue member having a thermal potential effective by introduction of combustible fuel thereinto, said thermal potential variable according to mechanical manipulation of at least one variable aperture dispositional between a minimum and a maximum opening and a pressure of said fuel introducible therethrough, wherein a sparking nexus, disposed at the ignition end of each flue member, is selectively productive of a spark when an electrical current is passed therethrough to ignite fuel delivered into said flue member, whereby each flue member is ignitable as a luminous and fiery picture element appropriate for rendering figures in fire in synchrony to the production of signals generated at a performance or programmed by an operator.

9 Claims, 7 Drawing Sheets

COMPUTER REGULATED AND CONTROLLED IGNITION AND COMBUSTION PYROTECHNIC DISPLAY APPARATUS AND METHOD

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of pyrotechnic apparatuses are known in the prior art. However, what is needed is a computer regulated and controlled ignition and combustion pyrotechnic display apparatus that includes a graticulate array of flue members oriented with an ignition end disposed in a common plane, each flue member having a thermal potential effective by introduction of combustible fuel thereinto, said thermal potential variable according to mechanical manipulation of at least one variable aperture dispositional between a minimum and a maximum opening and a pressure of said fuel introducible therethrough, wherein a sparking nexus, disposed at the ignition end of each flue member, is selectively productive of a spark when an electrical current is passed therethrough to ignite fuel delivered into said flue member, whereby each flue member is ignitable as a luminous and fiery picture element appropriate for rendering figures in fire in synchrony to the production of signals generated at a performance.

FIELD OF THE INVENTION

The present invention relates to a computer regulated and controlled ignition and combustion pyrotechnic display apparatus, and more particularly, to a computer regulated and controlled ignition and combustion pyrotechnic display apparatus that includes a graticulate array of flue members oriented with an ignition end disposed in a common plane, each flue member having a thermal potential effective by introduction of combustible fuel thereinto, said thermal potential variable according to mechanical manipulation of at least one variable aperture dispositional between a minimum and a maximum opening and a pressure of said fuel introducible therethrough, wherein a sparking nexus, disposed at the ignition end of each flue member, is selectively productive of a spark when an electrical current is passed therethrough to ignite fuel delivered into said flue member, whereby each flue member is ignitable as a luminous and fiery picture element appropriate for rendering figures in fire in synchrony to the production of signals generated at a performance.

SUMMARY OF THE INVENTION

The general purpose of the computer regulated and controlled ignition and combustion pyrotechnic display apparatus, described subsequently in greater detail, is to provide a computer regulated and controlled ignition and combustion pyrotechnic display apparatus which has many novel features that result in a computer regulated and controlled ignition and combustion pyrotechnic display apparatus which is not anticipated, rendered obvious, suggested, or even implied by prior art, either alone or in combination thereof.

The present computer regulated and controlled ignition and combustion pyrotechnic display apparatus has been devised to enable pyrotechnic displays coordinated intimately with digitized signals generated from a performance and input through a computing apparatus. A plurality of flue members is disposed in a graticulate array whereby each flue member is ignitable as a flaming picture element ("pixel") whereby animation, words, letters, icons, logos, and other figures are displayable in flame upon said graticulate array, synchronized with a performance by input of digital signals and thereby controllable by a computing apparatus.

The term "performance", as used herein throughout, is taken to include any performance whereat audio and/or video data signals are capturable for input into a computing apparatus to drive the present computer regulated and controlled ignition and combustion pyrotechnic display apparatus in programmable sequence and response thereto.

The present computer regulated and controlled ignition and combustion pyrotechnic display apparatus, therefore, includes two mechanisms by which to modulate a thermal potential of each of a plurality of flue members. The term "thermal potential", as used herein throughout, is taken to mean chemical energy releasable by selective ignition of combustible or flammable fuel introducible into each of the plurality of flue members at a range of rates, whereby a greater or lesser volume of said fuel is selectively ignitable and respectively greater or lesser energy is releasable thereby. Modulation of the thermal potential by controlling the volume of fuel introduced into each flue member and the moment of ignition thus enables a range of thermal potential between a minimum thermal potential and a maximum thermal potential.

Selective ignition at each flue member is effective by means of a sparking nexus disposed at an ignition end of each of the plurality of flue members. The sparking nexus produces a spark when an electrical current is activated therein. Any fuel interior to the flue member will ignite when the sparking nexus is activated. Each sparking nexus is controlled by a computing apparatus running at least one processor disposed to drive the computer regulated and controlled ignition and combustion apparatus. Thus oscillations of electrical current through each sparking nexus enable selective ignition at each flue member whereby flaming pixels are producible, as desired, in synchrony with signals generated during a performance, or programmable by an operator, as desired.

The thermal potential of each flue member is variable by means of at least one variable aperture disposed therein, said at least one variable aperture dispositional between a minimum opening and a maximum opening. When the variable aperture is at the minimum opening no fuel is introducible into the respective flue member. When the variable aperture is disposed at the maximum opening, a maximum volume of fuel is introducible into the respective flue member at a maximum rate.

The computing apparatus is disposed in communicative control of each of the at least one variable apertures, whereby each of the plurality of flue members' thermal potential is drivable by the computing apparatus in response to input signals generated from a performance or programmed by an operator. The computing apparatus may, therefore, selectively increase or decrease the thermal potential of each of the plurality of flue members, thereby setting selective pixels for ignition or extinction whereby animations, icons, words, figures, characters, pictures, logos, glyphs, and other fiery figures and displays are effective, coordinated in synchrony to a performance or programmed by an operator, as desired. The computer may be disposed in wireless communication with the device, for remote operation thereof.

The rate of fuel introduction into each flue member is further variable in proportion to the pressure of fuel releasable into each flue member. Thus, a maximum thermal potential for any particular flue member is a function of the rate of fuel introduced thereinto (and thus the pressure at the fuel source) and the diameter of the at least one variable aperture. A maximum thermal potential of any particular flue member is therefore obtainable when a maximum pressure introduces a maximum volume of fuel into the flue member under the shortest time interval.

For the purposes of this specification, the term "relative maximum thermal potential" will be applied to a maximum volume of fuel introducible into a flue member at a particular pressure when the at least one variable aperture is disposed at the maximum opening. Therefore, the term "relative maximum thermal potential" is applicable to the maximum opening of the at least one variable aperture at a certain pressure of fuel. The term "maximum thermal potential", as used hereinafter, applies to the introduction of fuel into a flue member at a maximum rate as a function of a maximum pressure in addition to the maximum opening of the at least one variable aperture.

Thus, a user is enabled to modulate signals to control flaming pixel elements across a graticulate array of flue members, each of said flue members having an ignition end disposed in a common plane. Flames are producible at each ignition end selectively and in programmable synchrony with a performance. Flame size is variable as a function of thermal potential, whereby larger or smaller flames are producible in synchrony to a performance.

It is further contemplated as part of this invention that flame color may also be variable, by introduction of combustible elements into each flue member, whereby flame color may change when combusting said combustible elements. For example, an increase of oxygen into the flue member may engender bluer flames. Introduction of co-solvents into specific fuels (such as chlorine donors, for example) may further modulate flame color, as desired.

Thus has been broadly outlined the more important features of the present computer regulated and controlled ignition and combustion pyrotechnic display apparatus so that the detailed description thereof that follows may be better understood and in order that the present contribution to the art may be better appreciated.

Objects of the present computer regulated and controlled ignition and combustion pyrotechnic display apparatus, along with various novel features that characterize the invention are particularly pointed out in the claims forming a part of this disclosure. For better understanding of the computer regulated and controlled ignition and combustion pyrotechnic display apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
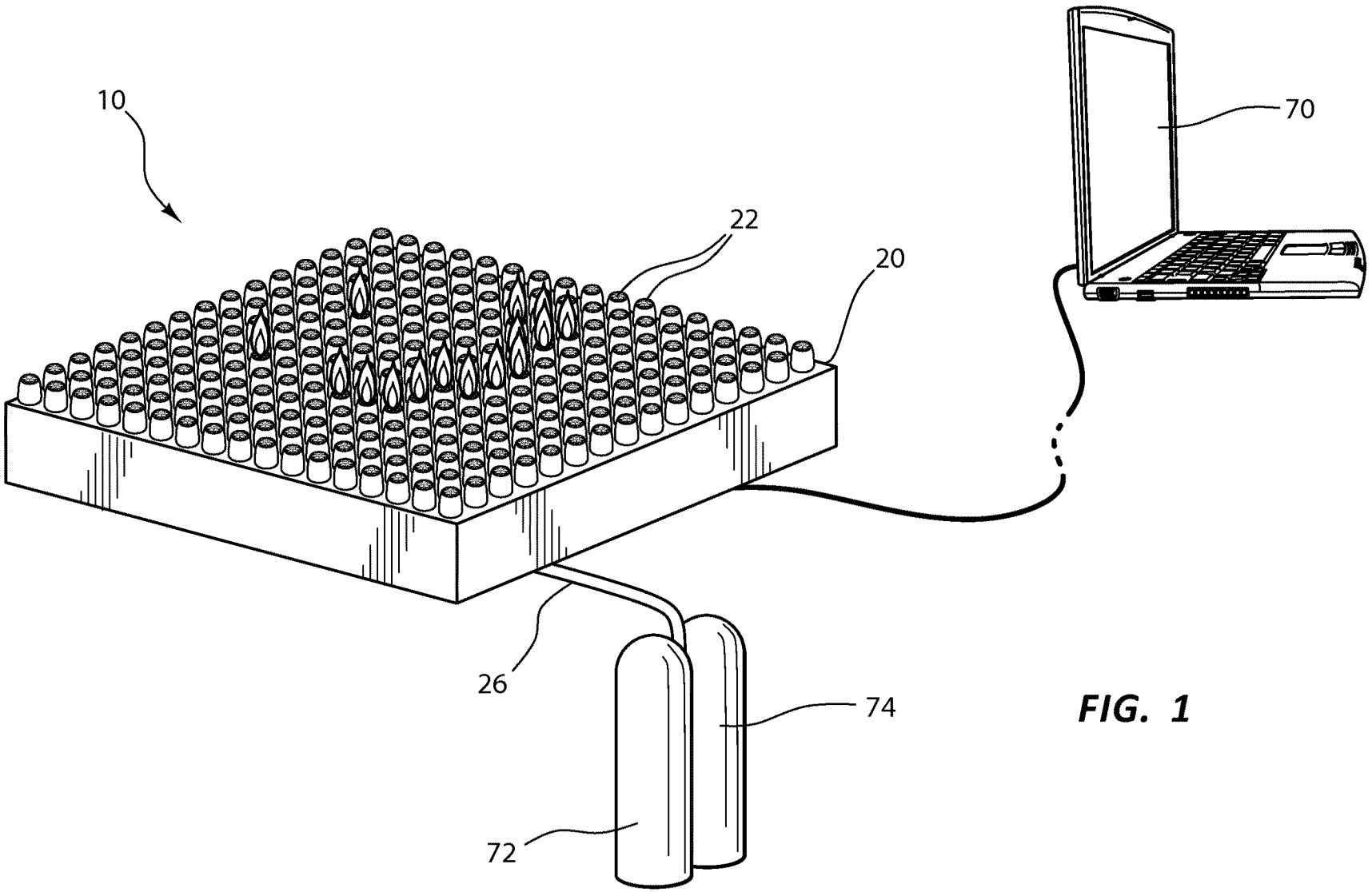
FIG. 1 is an isometric view of an embodiment.
Figure 2:
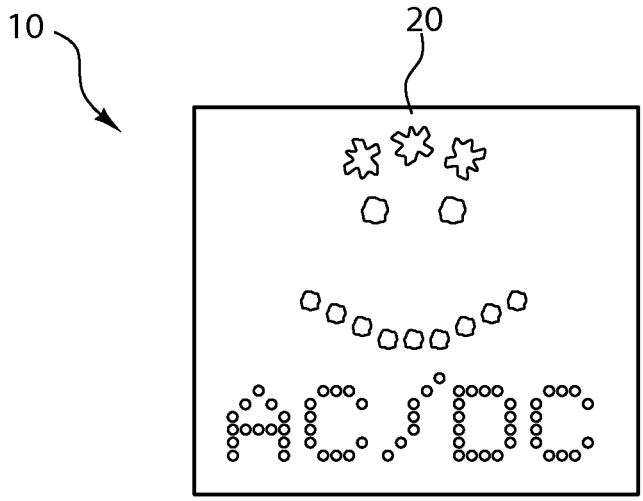
FIG. 2 is an top view of an embodiment.
Figure 3:
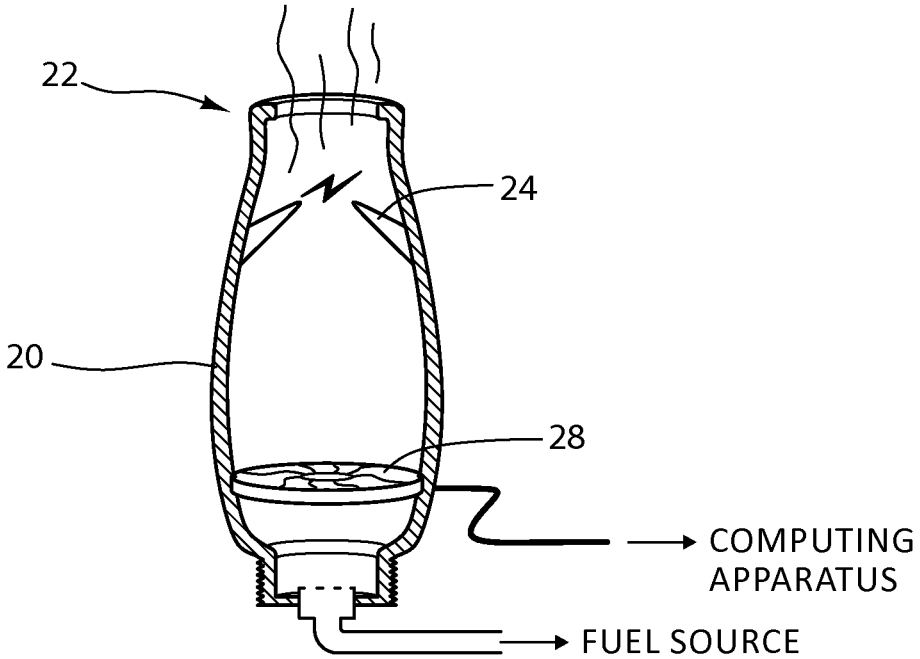
FIG. 3 is a cross-section view of a flue member.
Figure 4:
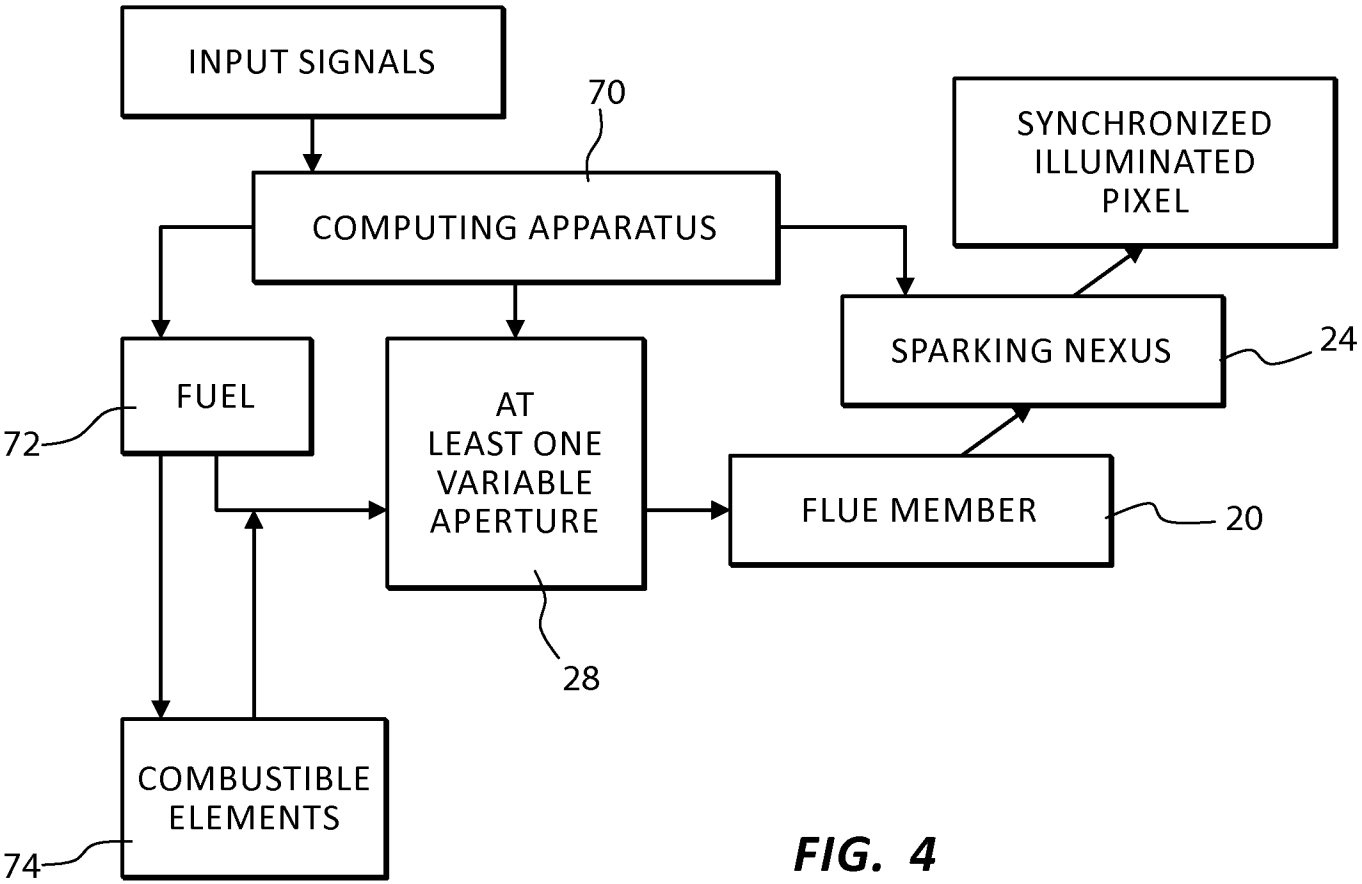
FIG. 4 is a block diagram view of an embodiment.
Figure 5:
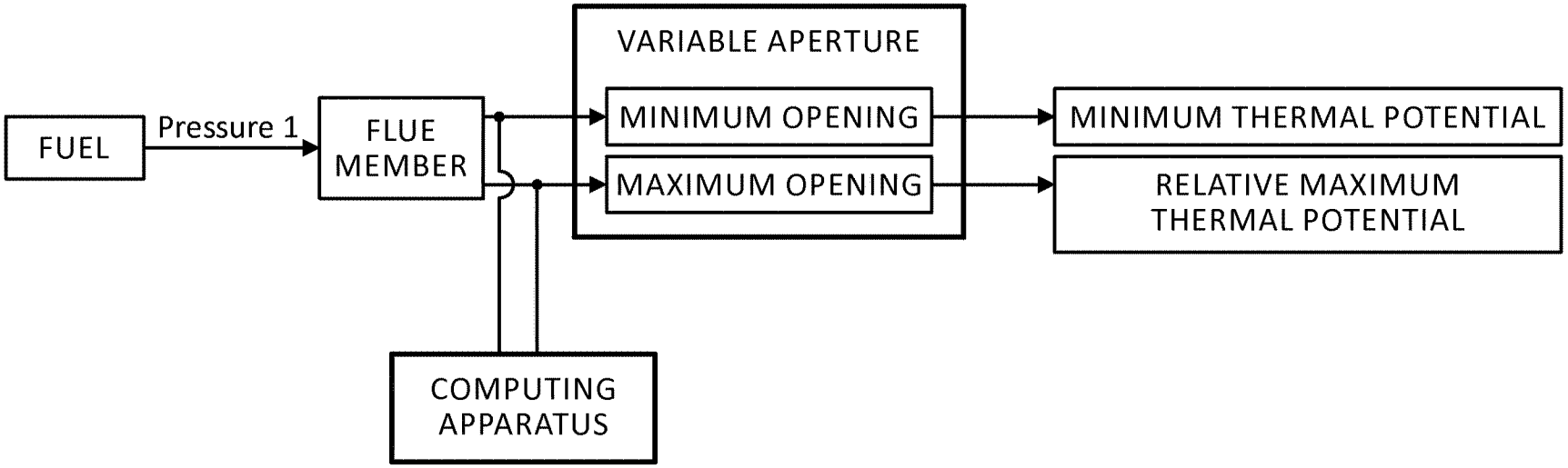
FIG. 5 is a block diagram of an embodiment illustrating control of a thermal potential between in minimum thermal potential and a relative maximum thermal potential.
Figure 6:
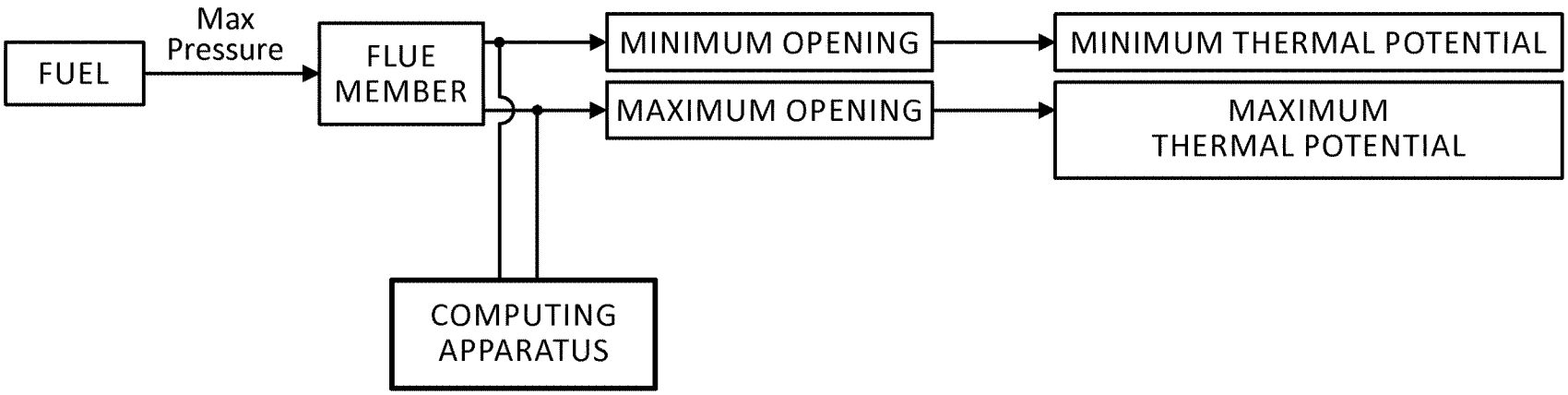
FIG. 6 is a block diagram of an embodiment illustrating control of a thermal potential between in minimum thermal potential and a maximum thermal potential.

With reference now to the drawings, and in particular FIGS. 1 through 7 thereof, example of the instant computer regulated and controlled ignition and combustion pyrotechnic display apparatus employing the principles and concepts of the present computer regulated and controlled ignition and combustion pyrotechnic display apparatus and generally designated by the reference number 10 will be described.

Referring to FIGS. 1 through 7 a preferred embodiment of the present computer regulated and controlled ignition and combustion pyrotechnic display apparatus 10 is illustrated.

The present invention 10 has been devised to enable coordinated pyrotechnical displays in conjunction with a performance. Input signals are digitized and a computing apparatus 70 running at least one processor drives the present invention 10 to ignite controllable volumes of combustible fuel, whereby position and size of flame is controllable in time with the production of input signals.

It is contemplated as part of this invention 10 that words and images will be effected by the device 10, rendered in flame, and animated in response to input signals produced onsite.

The present computer regulated and controlled ignition and combustion pyrotechnic display apparatus 10, therefore, includes a graticulate arrangement of flue members 20 disposed to align an ignition end 22 congruent within a common plane. Each of the flue members 22, therefore, comprises an illuminable picture element ("pixel") within the area covered by the graticulate arrangement.

An electrical sparking nexus 24 is disposed at the ignition end 22 of each flue member 20, said electrical sparking nexus 24 engendering production of a spark when an electrical current is passed therethrough. Thus, control of each electrical sparking nexus 24 disposed at the ignition end 22 of each flue member 20 is effective by oscillation of electrical current therethrough.

In order that combustible fuel be routable to each flue member 20, for ignition as desired, a conduit 26 is disposed connecting each flue member 20 to a source of pressurized, combustible fuel 72. At least one variable aperture 28 is disposed at each flue member 20, said variable aperture 28 mechanically effective between a maximum opening and a minimum opening. A computing apparatus 70 having at least one processor and running a driver is disposed in communicative control with each of the at least one variable apertures 28 whereby each said at least one variable aperture 28 is controllable to release a desired volume of fuel into the flue member 20 for ignition when an electrical current is applied through the sparking nexus 24. Thus, variably sized flames are enabled as a greater or lesser volume of combustible fuel is introduced into each flue member 20 for ignition therein when the sparking nexus 24 is engaged.

The frequency and amplitude of a flame, therefore, ignited at any particular flue member 20 ignition end 22, is producible and controllable by the computing apparatus 70 in programmable response to digitized signals inputted thereto. Introduction of volumes of combustible fuel into each flue member 20 is said herein to effect a "thermal potential" of said flue member 20. Disposition of the at least one variable aperture 28 to a diameter at the maximum opening, therefore, increases said thermal potential of an associated flue member 20 to a relative maximum thermal potential, by enabling a relative maximum rate of introduction of a relative maximum volume of fuel. A flame ignited at a relative maximum thermal potential will exhibit a relative maximum amplitude.

Conversely, disposition of at least one variable aperture 28 to a diameter at a minimum opening, therefore, decreases said thermal potential of an associated flue member 20 to a minimum thermal potential, by preventing introduction of combustible fuel into the flue member 20.

A sliding scale of flame amplitude, therefore, is enabled between the minimum thermal potential and the relative maximum thermal potential of each flue member 20, whereby controlled emissions and amplitude modulation of flame is enabled thereat in proportion to the disposition of the at least one variable aperture between the minimum opening and the maximum opening. Further, increasing or decreasing the pressure of the combustible fuel at the source of said fuel respectively increases or decreases the rate of introduction of said fuel into each flue member 20, as a function of the diameter of the at least one variable aperture 28. Thus a second order of flame amplitude modulation is producible at each flue member 20.

A maximum pressure, corresponding to a maximum rate of introduction of fuel into an associated flue member 20, to introduce a maximum volume of fuel into the flue member 20 over a minimum time interval, therefore, produces a maximum thermal potential at said flue member 20.

Thus digitized signals are translatable to coordinate pyrotechnic display, wherein selective ignition of each electrical sparking nexus 24 in conjunction with controlled variance of the diameter of each of the at least one variable apertures 28, dispositional between the minimum and maximum opening across a range of pressurized sources of fuel 72, is effective, and a thermal potential of each flue member 20 is variable and controllable by modulated introduction of combustible fuel thereinto, whereby controlled ignition of regulated flows of combustible fuel is enabled at the ignition end of each flue member 20 and coordinated fiery displays are thereby controllable in programmable reaction and desired proportion to the production of said digitized signals.

Flame color is likewise contemplated for manipulation by introduction of additional combustible elements 74 into a fuel source 72. Moreover, the at least one variable aperture 28 may be disposed in conjunction with an inlet aperture 30 to enrich oxygen into the associated flue member 20 and thereby burn a more oxygen rich flame.

Figure 7:
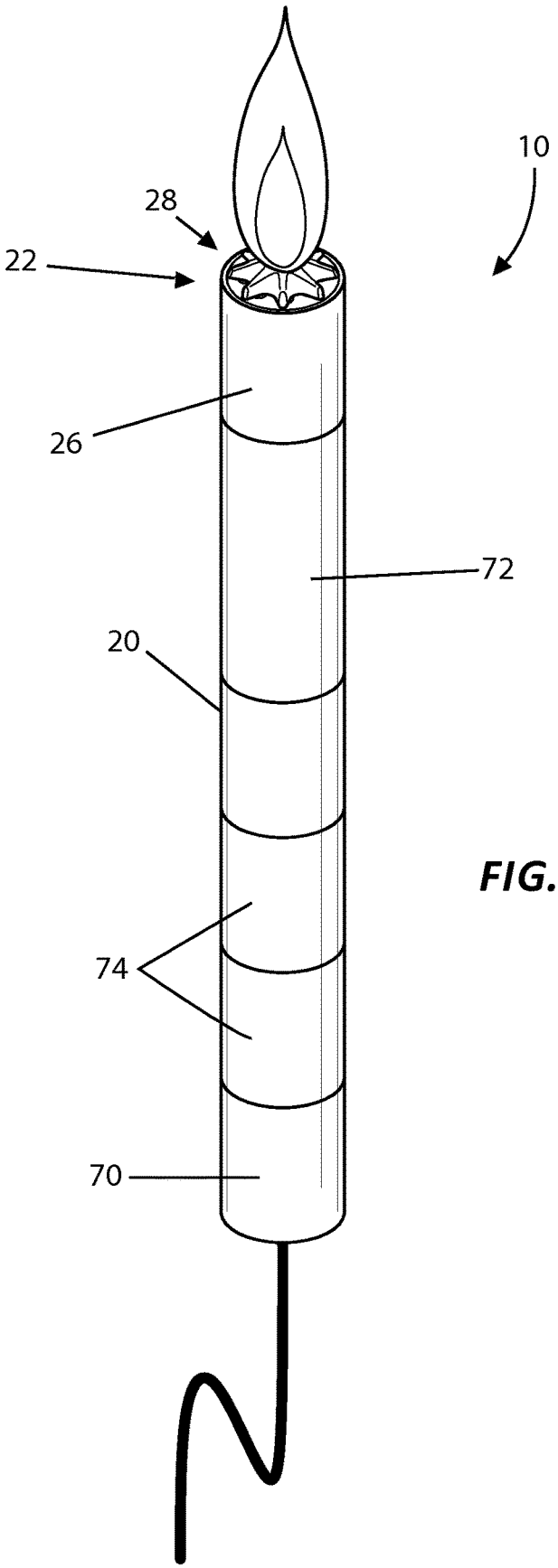
FIG. 7 is a diagrammatic view of an alternate embodiment of a single flue member.

An alternative embodiment is depicted in FIG. 7, wherein the flue member 20 is a self-contained unit that includes the computing apparatus 70 and the source of fuel 72 integrated into said flue member 20. The variable aperture 28 is disposed at the ignition end 22. A computing interface is connectable to the computing apparatus 70, which in this embodiment is a microprocessor, for driving of the device 10. In this embodiment, each flue member 20 is independently operable as a stand along unit, which, when assembled into an array of a plurality of such flue members, is operable to produce the same effect as previously described.

What is claimed is:

1. A computer regulated and controlled ignition and combustion pyrotechnic display apparatus coordinated and controlled by a computing apparatus, said computer regulated and controlled ignition and combustion pyrotechnic display apparatus comprising:

at least one flue member disposed connected to a pressurized fuel source, said at least one flue member having an ignition end whereat fuel, introducible into the at least one flue member across a range of rates, is selectively ignitable; and a sparking nexus disposed at the ignition end, said sparking nexus disposed in operative communication with the computing apparatus and electrically productive of a spark when an electric current is passed therethrough;

wherein said at least one flue member has a thermal potential controllable between a minimum thermal potential and a maximum thermal potential coordinated by the computing apparatus running at least one processor, whereby fiery displays are controllable in synchrony to a performance in programmable proportion to the selective ignition and thermal potential of each at least one flue member.

2. The computer regulated and controlled ignition and combustion pyrotechnic display apparatus of claim 1 wherein each flue member includes at least one variable aperture dispositional between a minimum opening and a maximum opening whereby influx of fuel into said flue member is controllable between a minimum volume of introduced fuel and a maximum volume of introduced fuel.

3. The computer regulated and controlled ignition and combustion pyrotechnic display apparatus of claim 2 wherein the source of fuel is variably pressurized for variable influx of fuel into each of the at least one flue members across a range of rates.

4. The computer regulated and controlled ignition and combustion pyrotechnic display apparatus of claim 3 wherein the at least one flue member includes a graticulate array of flue members wherein each ignition end is disposed as a picture element whereby ignition of each of said flue members corresponds to illumination of a picture element in a two dimensional figure.

5. The computer regulated and controlled ignition and combustion pyrotechnic display apparatus of claim 4 wherein the ignition of end of each of flue member is aligned within a congruent plane.

6. The computer regulated and controlled ignition and combustion pyrotechnic display apparatus of claim 5 wherein the fuel includes admixtures of co-solvents whereby flame color is also variable.

7. A computer regulated and controlled ignition and combustion pyrotechnic display apparatus comprising:

a graticulate arrangement of flue members disposed to align an ignition end congruent within a common plane;

an electrical sparking nexus disposed at the ignition end of each flue member, said sparking nexus disposed in operative communication with the computing apparatus and electrically productive of a spark when an electric current is passed therethrough;

a conduit connecting each flue member to a pressurized source of combustible fuel;

at least one variable aperture disposed at each flue member, said at least one variable aperture mechanically effective between a maximum opening and a minimum opening; and a computing apparatus having at least one processor and running a driver, said computing apparatus disposed in controlling communication with each variable aperture and each electrical sparking nexus;

wherein digitized signals are translatable to effect selective ignition of each electrical sparking nexus in conjunction with variance of the diameter of each of the at least one variable apertures dispositional between the minimum and maximum opening, to thereby effect a thermal potential of each flue member by controllable introduction of combustible fuel thereinto, whereby controlled ignition of regulated flows of combustible fuel is enabled interior to each flue member and coordinated and modulated fiery displays are thereby controllable in programmable reaction and desired synchrony to the production of said digitized signals.

8. The computer regulated and controlled ignition and combustion pyrotechnic display apparatus of claim 7 wherein the fuel includes admixtures of co-solvents whereby flame color is also variable.

9. A method enabling computer regulated and controlled ignition and combustion of a programmable pyrotechnic display comprising the steps of:

digitizing signals into a set of discrete values;

delivering said digital signals as electrical impulses to at least one flue member remotely disposed relative a source of said signals;

enabling mechanical action of at least one variable aperture disposed at said at least one flue member between a minimum opening and a maximum opening, whereby a flow of combustible fuel is controllably introducible thereinto in desired response to delivery of said digitized signals;

effecting timed and selective ignition of an electrical sparking nexus disposed to ignite a volume of fuel introduced into an associated at least one flue member; and admixing co-solvents with the fuel to vary flame color;

wherein programmable pyrotechnic displays are remotely controllable coordinated to signals including rhythms, melodies, and other audio and video signals, whereby flames are producible at various magnitudes and positions appropriate to the creation of visual stimuli consonant with a performance production.

* * * * *